US007202836B2

(12) United States Patent
Ooi et al.

(10) Patent No.: US 7,202,836 B2
(45) Date of Patent: Apr. 10, 2007

(54) ANTENNA APPARATUS AND METHOD OF FORMING SAME

(75) Inventors: Sooliam L. Ooi, Plantation, FL (US); Nereydo T. Contreras, Plantation, FL (US); Boon Ping Koh, Petaling Java (MY); Christos Kontogeorgakis, Plantation, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/123,307

(22) Filed: May 6, 2005

(65) Prior Publication Data

US 2006/0250319 A1 Nov. 9, 2006

(51) Int. Cl.
*H01Q 1/36* (2006.01)

(52) U.S. Cl. ..... 343/895; 343/702

(58) Field of Classification Search ..... 343/702, 343/895

See application file for complete search history.

(56) References Cited

U.S. PATENT DOCUMENTS

| | | | | |
|---|---|---|---|---|
| 6,140,973 | A * | 10/2000 | Annamaa et al. | 343/790 |
| 6,201,500 | B1 * | 3/2001 | Fujikawa | 343/702 |
| 6,288,681 | B1 * | 9/2001 | Kim et al. | 343/702 |
| 6,337,669 | B1 * | 1/2002 | Chiang | 343/895 |
| 6,473,056 | B2 * | 10/2002 | Annamaa | 343/895 |
| 6,518,938 | B1 * | 2/2003 | Chaoo | 343/895 |
| 6,597,326 | B2 * | 7/2003 | Chen | 343/895 |

* cited by examiner

*Primary Examiner*—Tan Ho

(57) ABSTRACT

An antenna provides dual band capability by providing a single feed (102) leading into a helix (104), the helix characterized by a pitch (106) and number of turns (120) varied to provide dual band operation to a portable communication device.

2 Claims, 9 Drawing Sheets

TOP VIEW OF RADIO SHOWING PHI=0-360, THETA=90.

SIDE VIEW OF RADIO SHOWING THETA=0-360, PHI=0.

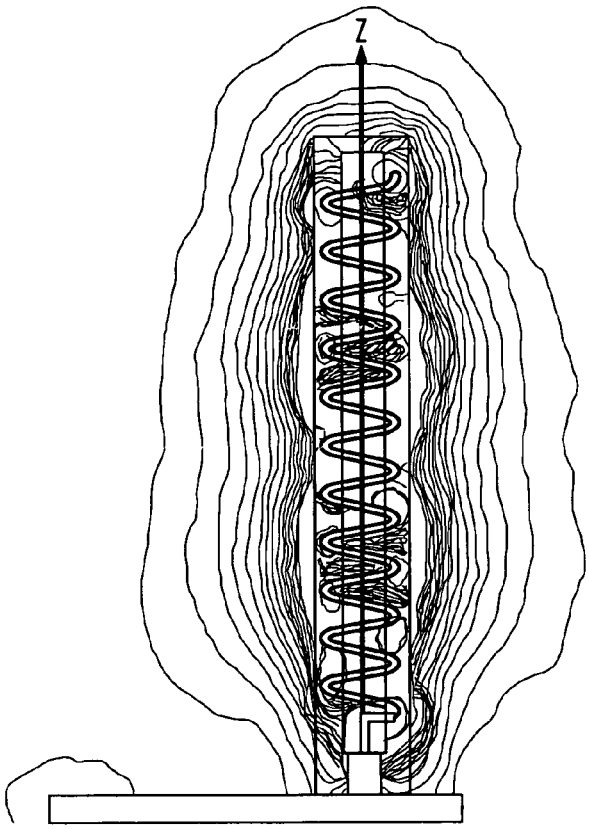
UNCOMPRESSED HIGH POTENTIAL POINTS, INDICATED BY CONCENTRATED LINES.
FIG. 10
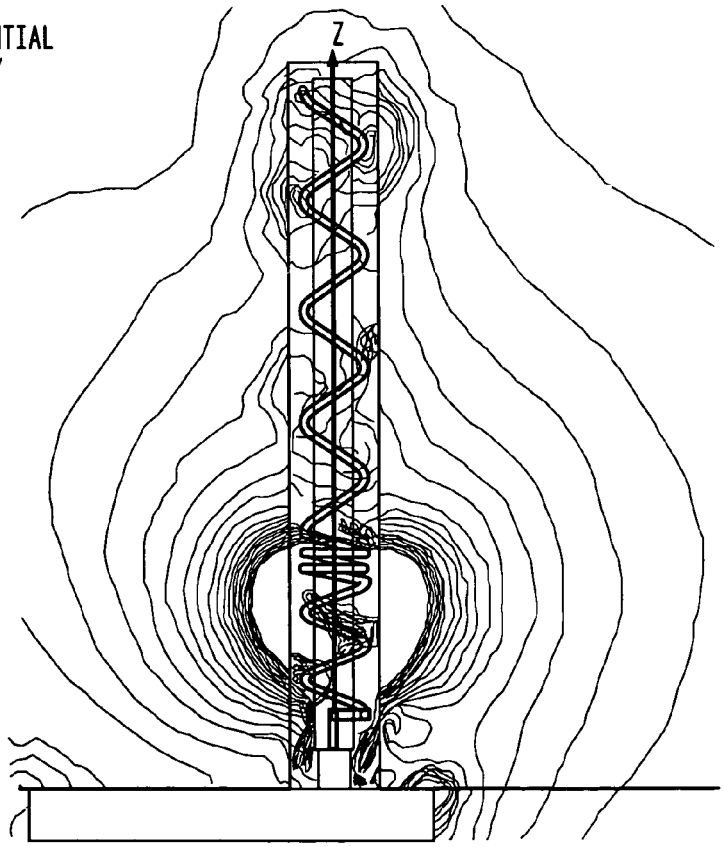
COMPRESSED, CONCENTRATED HIGH POTENTIAL POINT.

ANTENNA APPARATUS AND METHOD OF FORMING SAME

FIELD OF THE INVENTION

The present invention relates generally to antennas for use with communication devices and more specifically to dual band antennas used in portable communication devices.

BACKGROUND OF THE INVENTION

As communication devices continue to evolve, device capabilities continue to expand. One such capability is dual band operation which allows a communication device, such as a portable radio, to operate over two independent frequency bands, for example a UHF band and a GPS band. The ability to provide dual band operation presents challenges to designers in terms of performance, robustness, reliability and manufacturing costs. The end user of the communication device desires simple operation without user intervention.

A variety of antenna configurations have attempted to address the need for dual band UHF/GPS operation, each configuration plagued with issues. For example, a folded sleeve monopole antenna configuration faces issues with length because the overall finished antenna length can not be shorter than one electrical length at the GPS frequency. Another approach to dual band UHF/GPS operation utilizes a concentric monopole having a quarter wavelength at GPS frequencies in conjunction with a helix having a quarter wavelength at UHF frequencies. However, this approach implements multiple parts increasing complexity and manufacturing cost. These prior approaches also require the use of a coaxial connector, such as SMA, TNC or mini UHF connectors, which greatly impacts overall manufacturing cost.

Accordingly, it would be desirable to have a dual band antenna that overcomes the aforementioned problems.

BRIEF DESCRIPTION OF THE FIGURES

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

FIG. 10 shows a simulation of charge accumulation forming a high potential point at a choke section of an antenna formed in accordance with the present invention versus a simulation of charge distribution for an antenna lacking a choke section;

Figure 1:
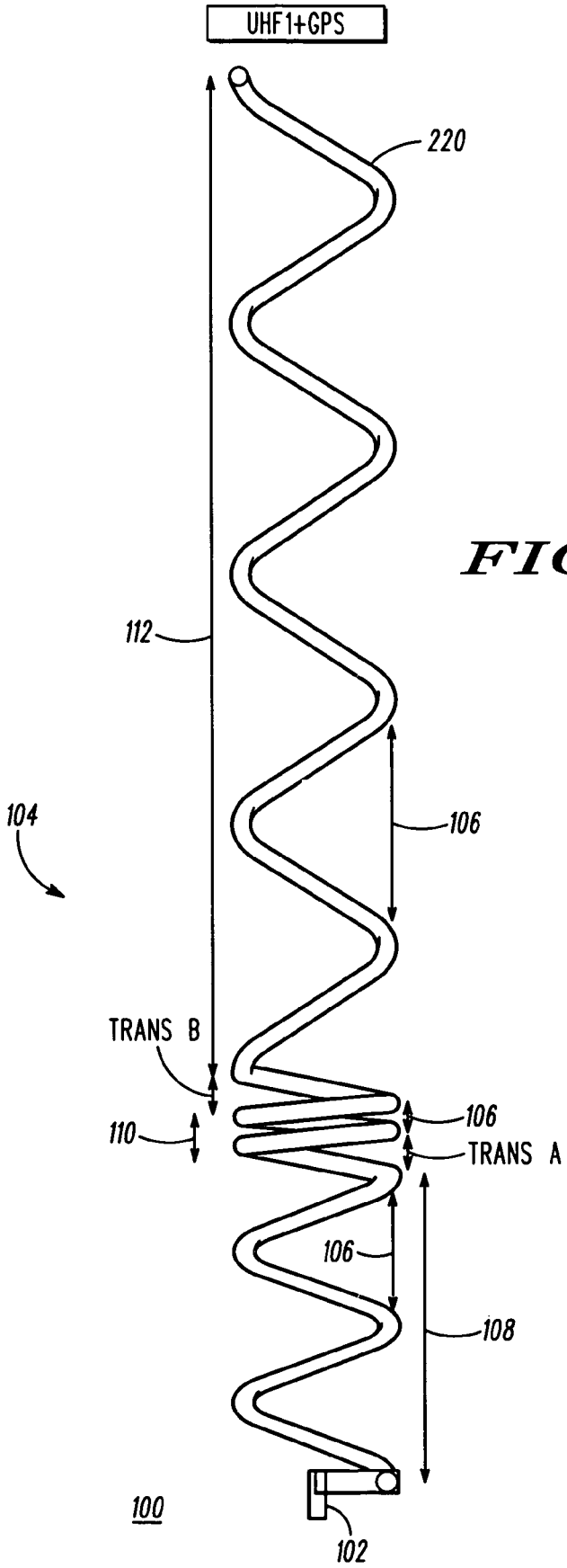
FIG. 1 illustrates an antenna formed in accordance with the present invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF THE INVENTION

Before describing in detail embodiments that are in accordance with the present invention, it should be observed that the embodiments reside primarily in combinations of method steps and apparatus components related to forming a dual band antenna and a communication device implementing the dual band antenna. Accordingly, the apparatus components and method steps have been represented where appropriate by conventional symbols in the drawings, showing only those specific details that are pertinent to understanding the embodiments of the present invention so as not to obscure the disclosure understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

FIG. 1 illustrates an antenna 100 formed in accordance with the present invention. Antenna 100 comprises a single feed 102 leading into a helix 104, the helix characterized by a helix pitch 106 varied so as to provide dual band resonant frequencies. For the purposes of this application, the helix pitch 106 will be defined as the spacing, distance or gap between turns/windings 120. Antenna 100 provides a single radiating element in the form of helix 104, wherein the helix is preferably divided into a plurality of sections, shown here as three sections 108, 110, 112, originating from the single feed 102. In accordance with the present invention, first section 108 provides a first frequency band of operation, such as GPS operation, second section 110 provides a choke and first, second and third sections 108, 110, 112 provide a second frequency band of operation, such as UHF operation.

Figure 2:
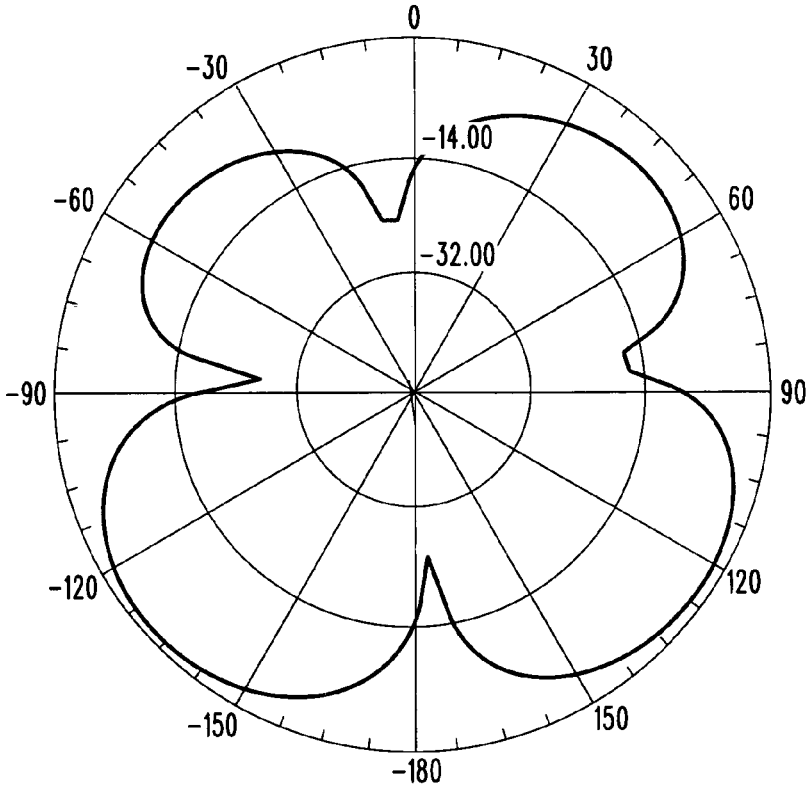
FIG. 2 is a four lobe radiation pattern measured for an antenna formed in accordance with an exemplary embodiment of the invention showing GPS operation.

First section 108, also referred to as the base or bottom section, is designed to have an effective electrical length of a quarter wavelength at the higher frequency band, in this case, the GPS band. Sections 108, 110, 112 are configured to provide a 1.25 wavelength at GPS frequencies. In accordance with the present invention, the pitch of section 108 is adjusted to maintain a four-lobe radiation pattern as seen in FIG. 2 as well as for impedance matching.

Second section 110 of helix 104 is a tightly wound section serving two purposes. Firstly, section 110 acts as a choke to reduce current flow to the upper section 112 thus concentrating the current on the first section 108. Secondly, section 110 builds up a charge accumulation and forms a high potential point.

Figure 3:
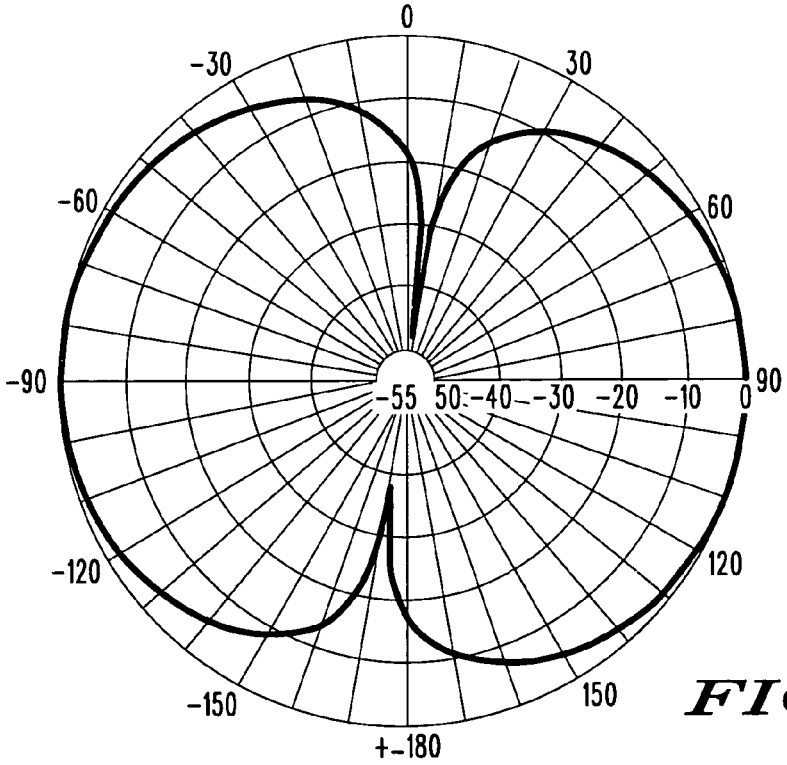
FIG. 3 is a two lobe radiation pattern measured for an antenna formed in accordance with an exemplary embodiment of the invention showing UHF operation.

The number of turns and pitch for the third section 112 are manipulated to produce a total electrical length for the entire helix to be at a predetermined design lengths (for example, 1.25λ for GPS, 0.25λ for UHF). Antenna 100 provides a four lobe radiation pattern at GPS frequencies as shown in FIG. 2—this radiation pattern is the equivalent of a 1.25 wavelength end-fed dipole. The same antenna 100 results in a two lobe radiation pattern at UHF frequencies as shown in FIG. 3.

Figure 4:
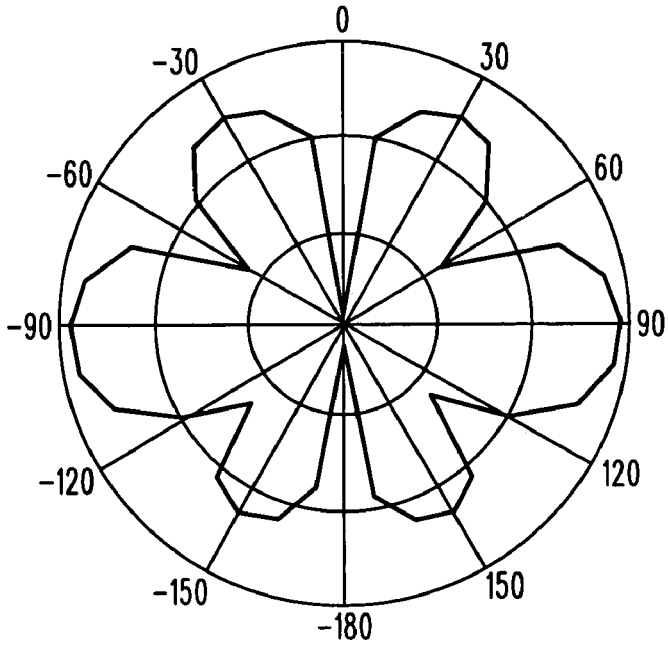
FIG. 4 is a simulated six lobe pattern.

For comparison's sake, a six lobe radiation pattern was simulated, as shown in FIG. 4, to illustrate what might happen if the number of turns and pitch are not manipulated in accordance with the invention. Thus, appropriate manipulation of the helix pitch and number of turns is needed to achieve the desired dual band operation.

Briefly, the method of designing an antenna in accordance with the present invention can be summarized by forming a single radiating element of a helix and adjusting the number of turns of the helix and helix pitch to form sections providing dual band resonant frequencies. The step of adjusting preferably includes the step of compressing the helix pitch 106 so as to form a choke between two sections 108, 112, at section 110 in FIG. 1, to maintain a four lobe radiation pattern at GPS and a two lobe radiation pattern for UHF.

Figure 5:
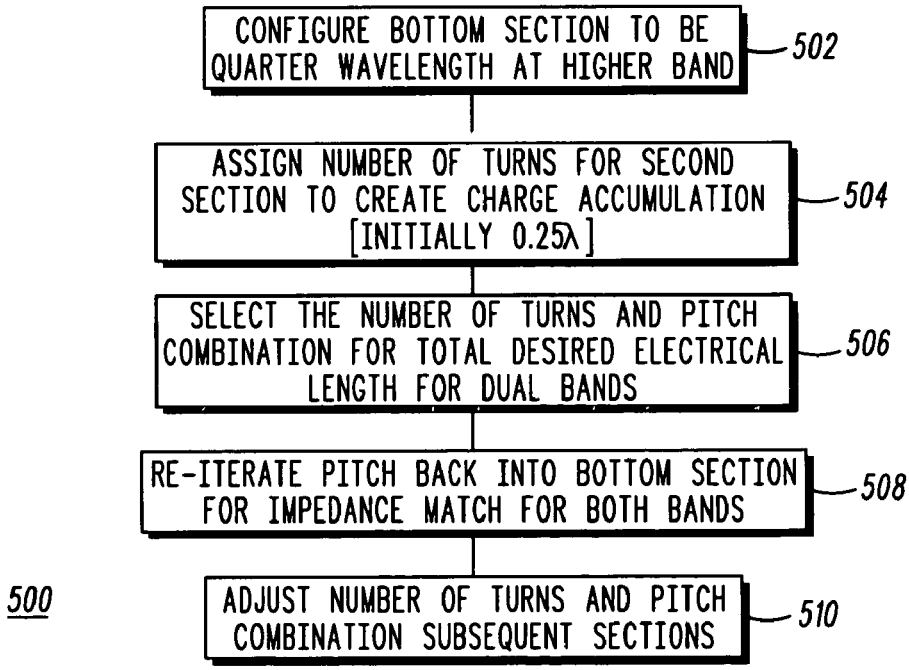
FIG. 5 is a flowchart of a method of forming the antenna of the present invention.

FIG. 5 is a flowchart illustrating the method of forming an antenna for dual band UHF, GPS operation in accordance with an exemplary embodiment of the invention. Method 500 begins at step 502 by initially configuring the bottom section 108 of the antenna to be a quarter wavelength at GPS. At 504, the step of assigning the number of turns for the second section 110 to provide for charge accumulation is performed. For example two turns having an electrical length of 0.25λ can be used to create a charge accumulation in section 110. At 506, the step of selecting the number of turns and pitch combination for the third section 112 to produce a total electrical length for the entire helix to be at predetermined design lengths (1.25λ for GPS, 0.25λ for UHF) is completed. At 508, the step of re-iterating the choice of pitch for first section 108 to obtain a good impedance match for both GPS and UHF bands is completed, followed by the step of adjusting the number of turns and pitch combination for the subsequent sections such that the electrical length for both bands total up to the desired lengths at step 510.

Manipulating the pitch of the radiating element to achieve both resonant frequencies and the desired radiation pattern greatly simplifies antenna design for multi-band products. Utilizing a single radiating element for the antenna 100 reduces parts count and manufacturing complexity as well as enables flexible adaptation of the antenna to different connector schemes. The antenna element can be mounted to a chassis using a ferrule or MX connector or fastened directly on the transceiver board using screws or similar fasteners. The antenna formed in accordance with the present invention does not require a coaxial connector providing a significant advantage over previous configurations.

Figure 6:
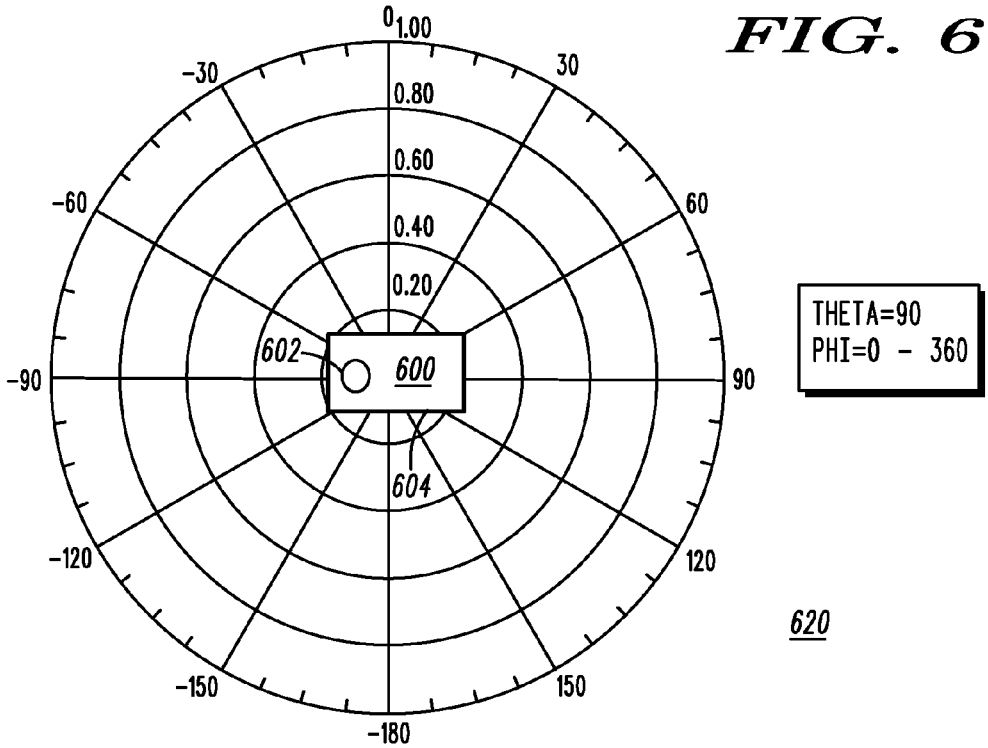
FIG. 6 represents an antenna formed in accordance with the present invention mounted to a portable communication device for various orientation measurements.
Figure 6:
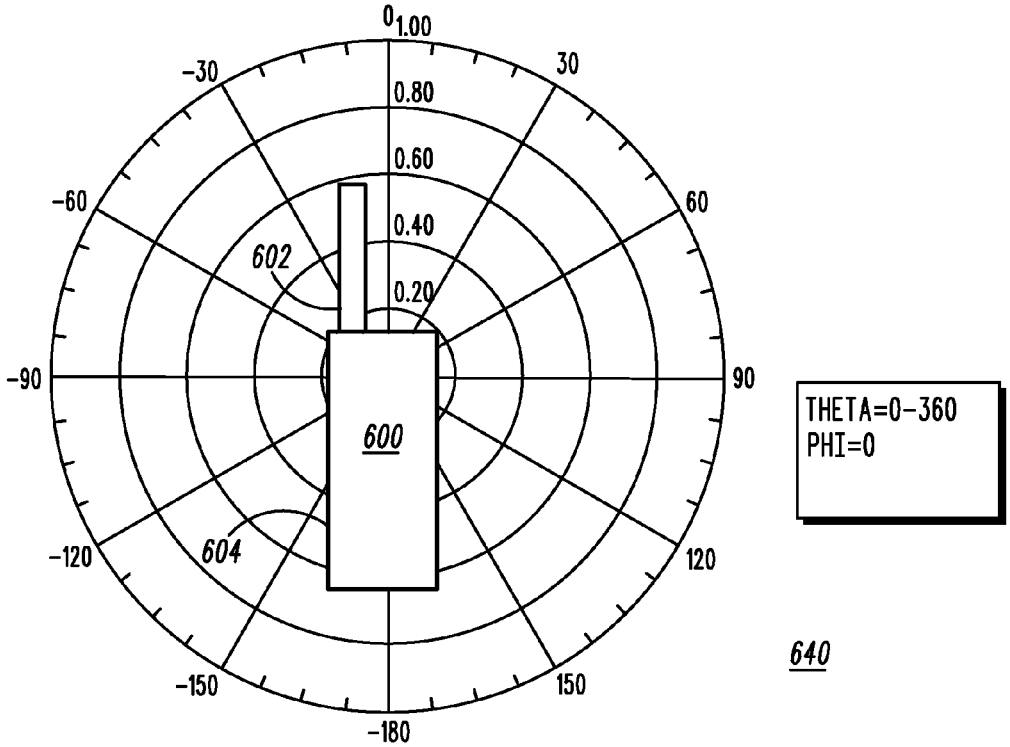

Table 1 represents an example of dimensions used in forming two antennas in accordance with an exemplary embodiment of the invention. The two antennas were designed to cover UHF frequency bands in two splits, 403–435 MHz (UHF1), 430–470 MHz (UHF2), and GPS 1.575 MHz for a low power portable radio device, such as illustrated in FIG. 6.

TABLE 1

Examples of design dimensions for two UHF Helical Antennas.

| Section | Pitch (mm) | Turn |
|---|---|---|
| | UHF1 + GPS | |
| 1 | 8.0 | 2.0 |
| Transition A | 3.0 | 0.5 |
| 2 | 1.5 | 1.5 |
| Transition B | 3.0 | 0.5 |
| 3 | 13.0 | 4.0 |
| | UHF2 + GPS | |
| 1 | 8.0 | 2.0 |
| Transition A | 3.0 | 0.5 |
| 2 | 1.5 | 1.5 |
| Transition B | 3.0 | 0.5 |
| 3 | 13.0 | 3.5 |

In accordance with the exemplary embodiment of the invention, the helix pitch 106 was manipulated, as shown in Table 1, to provide a resonance at UHF, with appropriate matched bandwidth meeting conventional UHF commercial band splits, as well as the GPS frequency. Referring to Table 1, a wire (1.0 mm diameter) was wound on a cylindrical rod (6.0 mm diameter) with a coarse length of a quarter wavelengths at UHF. Then, the pitch of the helix was maintained at 8.0 mm using a gap gauge. After 2 turns from the bottom of the helix, the helix pitch was compressed as close as possible. Compressing the helix in this manner creates a choke which produces another standing wave. Effectively, this approach combines the second and third harmonics at the GPS frequency without sacrificing performance at the UHF band.

Referring to Table 2, the electrical length of the helix is related to the number of helical turns. A parameter referred to as "wavelength per turn" is thus defined. From this parameter, the resultant electrical length produced by one turn of the helix of a particular pitch is calculated. For example, if it takes 5 turns to make 0.25 wavelength, then 1 turn produces 0.05 wavelength. If the designer wishes to "fit in" a 0.35 wavelength section, then (0.35/0.05=7) 7 turns would be used. Table 2 shows examples for two frequency bands, GPS and UELF, for the GPS UHF1 antenna.

TABLE 2

| Pitch | Number of turns | GPS wavelength per turn | GPS resultant wavelength | UHF wavelength per turn | UHF resultant wavelength |
|---|---|---|---|---|---|
| 2 | 2.5 | 0.228892544 | 0.228892544 | 0.017795139 | 0.044488 |
| 3 | 0 | 0 | 0 | 0.017182131 | 0 |
| 4 | 0 | 0 | 0 | 0.017407718 | 0 |
| 6 | 9.25 | 0.769350962 | 0.769350962 | 0.018193493 | 0.16829 |
| 8 | 2.83 | 0.249871032 | 0.249871032 | 0.02025463 | 0.057321 |
| 10 | 0 | 0 | 0 | 0.022992886 | 0 |
| | total | accumulated wavelength | 1.248114537 | | 0.270098 |

FIG. 6 illustrates a portable communication device 600 incorporating an antenna 602 formed in accordance with the present invention. The antenna is mounted to a radio chassis and oriented per phi, theta orientations 620,640 as indicated. Portable communication device 600 is formed of a chassis housing 604 upon which the single feed antenna 602 is coupled in accordance with the present invention. The single feed antenna 602 is formed of a helix characterized by a plurality of pitches manipulated to provide dual band operation, such as UHF and GPS operation. The single feed antenna 602 is preferably covered with a sheath, such as a polyurethane sheath or the like. Table 3 represents examples of data taken using the two antennas formed in accordance with the exemplary embodiment (UHF 1/GPS and UHF2/GPS) in conjunction with the portable communication device orientations shown in FIG. 6.

Table 3 shows peak and average gains measured for both the UHF1/GPS and UHF2/GPS antennas. The data shown in Table 3 was taken with each antenna operating autonomously receiving signals from individual orbiting satellites. The parameter C/N0 is the ratio of the power of the GPS carrier wave C [dBW] to the noise power density N0 [dBW-Hz]. This is the main parameter to characterize sensitivity of a GPS unit. As seen from Table 3, signals picked up by the antennas were strong, with a typical C/No of 35.0, which is considered strong for GPS applications.

TABLE 3

Examples of peak and average gain obtained with UHF1 and UHF2 antennas

| | UHF1 | | | UHF2 | | |
|---|---|---|---|---|---|---|
| | Frequency (MHz) | Peak Gain (dB) | Average Gain (dB) | Frequency (MHz) | Peak Gain (dB) | Average Gain (dB) |
| Phi = 0 | 400 | −2.334 | −8.632 | 435 | −0.934 | −7.269 |
| | 420 | −1.998 | −8.426 | 450 | −0.491 | −6.796 |
| | 435 | −1.412 | −7.794 | 470 | −2.383 | −8.687 |
| | 1575 | −4.879 | −12.933 | 1575 | −4.516 | −14.439 |
| Phi = 90 | 400 | −2.442 | −8.568 | 435 | −0.861 | −7.206 |
| | 420 | −1.867 | −8.146 | 450 | −0.185 | −6.544 |
| | 435 | −1.073 | −7.445 | 470 | −2.089 | −8.409 |
| | 1575 | −2.888 | −10.399 | 1575 | −2.522 | −12.354 |
| Theta = 90 | 400 | −1.458 | −1.969 | 435 | −0.903 | −1.509 |
| | 420 | −0.232 | −0.898 | 450 | −0.948 | −1.501 |
| | 435 | −1.453 | −2.095 | 470 | −1.544 | −2.122 |
| | 1575 | −6.658 | −12.128 | 1575 | −7.280 | −12.766 |

Antennas formed in accordance with the present invention can be adjusted to meet a variety of design requirements. The antenna dimensions and data sited above are shown for the purposes of example only. One skilled in the art will recognize that the wire gauge, helix pitch and materials can be adapted to fit a variety of frequency band applications and product spacing requirements. When a wire is wound into a helix, the distributed capacitance loads the wire into having a shorter electrical length. The electrical length of a helix is determined by the helix diameter and the pitch. If product requirements dictate that the diameter be fixed, then only the pitch is manipulated.

Figure 7:
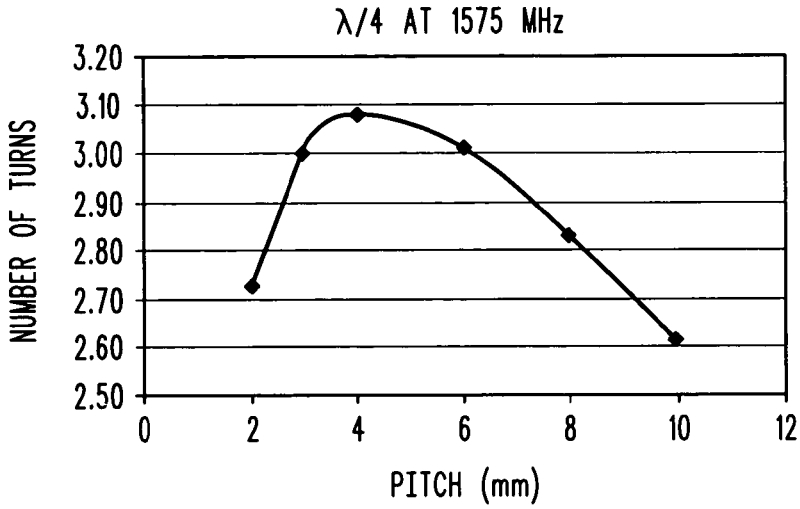
FIG. 7 is a graph representing an example of wire length versus pitch to achieve an electrical length of one and a quarter wavelength at a GPS frequency of 1575 MHz in accordance with an exemplary embodiment of the invention.
Figure 8:
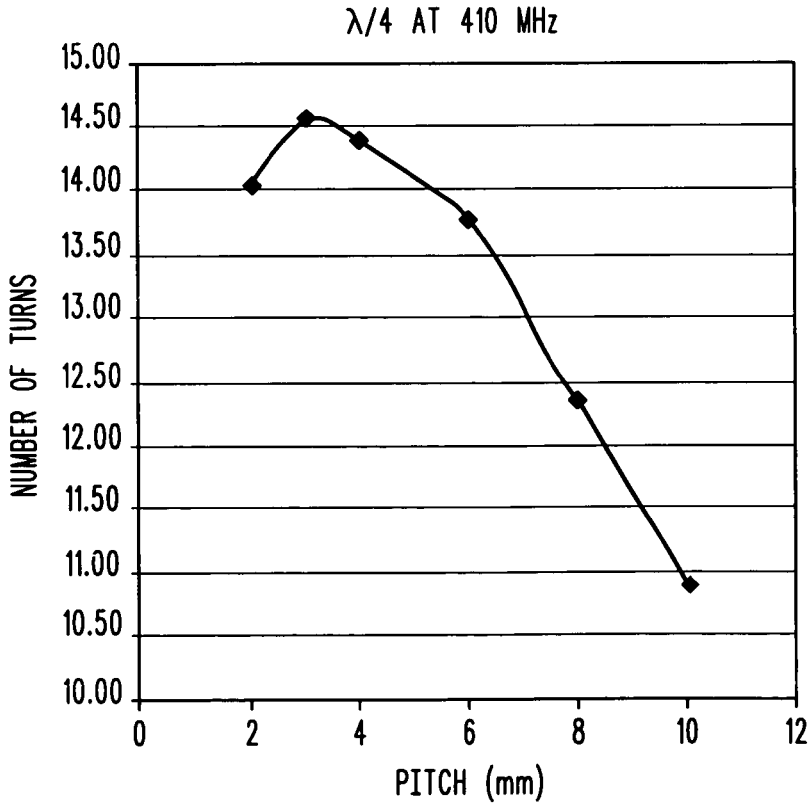
FIG. 8 is a graph representing an example of the number of turns versus pitch to achieve an electrical length of one quarter wavelength at a UHF frequency of 410 MHz in accordance with an exemplary embodiment of the invention.

FIG. 7 shows a diagram representing an example of wire length (mm) versus pitch (mm) to achieve an electrical length of a quarter wavelength at a GPS frequency of 1575 MHz. FIG. 8 shows a diagram representing an example of the number of turns versus pitch (mm) to achieve an electrical length of one quarter wavelength for a center frequency of 410 MHz. As an example, the case in which an antenna is designed to work for both UHF and GPS, the total electrical length of all the sections must add up to 0.25 wavelength for UHF and 1.25 wavelength for GPS in order for the antenna to be matched to the impedance and have the desired radiation patterns at both frequencies.

Figure 9:
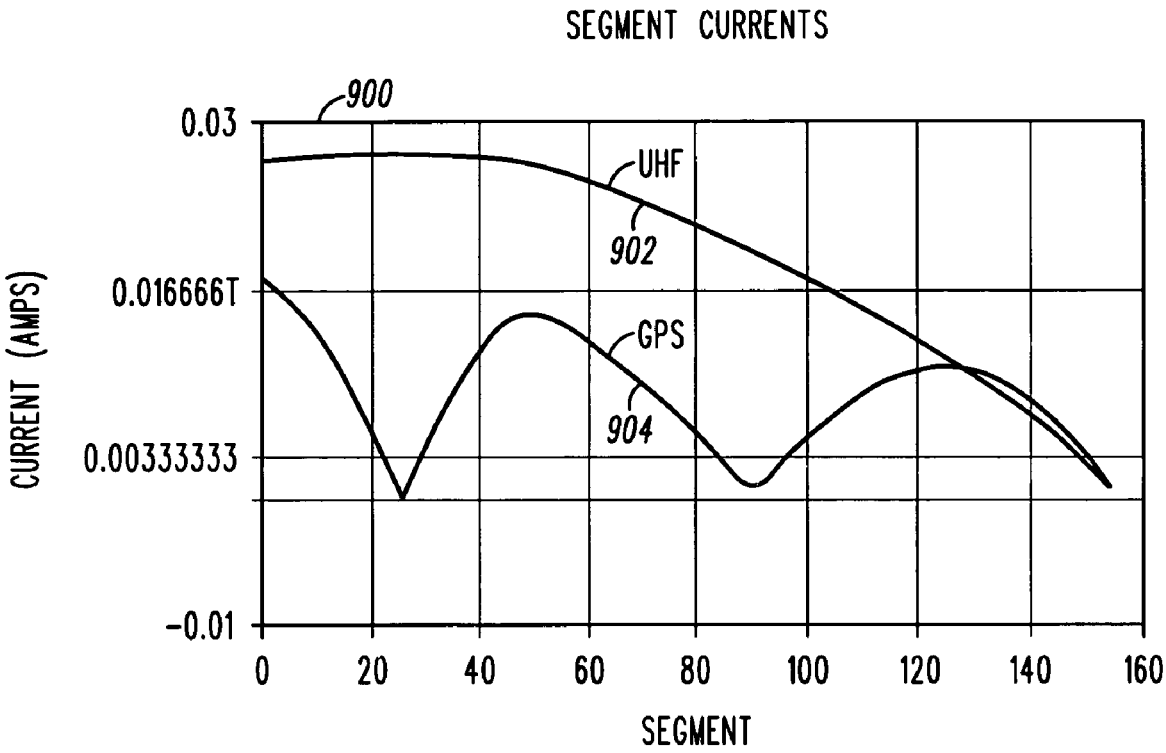
FIG. 9 is a graph representing a simulation of current distribution over segment portions of an antenna wire formed in accordance with an exemplary embodiment of the invention.

Finally, FIG. 9 shows a graph 900 representing a simulation of current distribution of both UHF and GPS bands over segment portions of the antenna wire. Curve 902 shows how the current distribution for the UHF band varies over the wire segments for a quarter wavelength. Curve 904 shows how the current distribution for the GPS band varies over the wire segments for one and a quarter wavelengths. Graph 900 thus further illustrates the antenna formed in accordance with the present invention has an electrical length of 1.25λ at GPS and 0.25λ at UHF bands. FIG. 10 shows a simulation of charge accumulation build up forming a high potential point in section 1110 of antenna 1000 versus a simulation of charge distribution for an antenna 1000 lacking a middle choke section. Accordingly, there has been provided a method and apparatus of forming a multi band antenna based on the concept of creating multiple resonances on a single element helix by manipulating the pitch and number of turns over portions of the length of the helix. While the examples provided thus far have demonstrated dual band operation, the concept also applies to antennas covering additional bands. The electrical length of the helical antenna is determined by: the physical wire length; the reactance contributed by the coil; and inductance and the inter-winding capacitance on the helical element. The major tuning parameters determining impedance of the antenna are: number of turns, N, pitch, p, the pitch, p, being the key parameter in setting the resistive part of the impedance, affecting the magnitude of maximum current at the feed point; helix diameters, d, wire size. All parameters contribute to the total wire length $L=N\sqrt{(\Pi^2+p^2)}$). The pitch, or separation between the turns, p, and the wire size, also contributes to the overall series capacitance of the helix.

Figure 11:
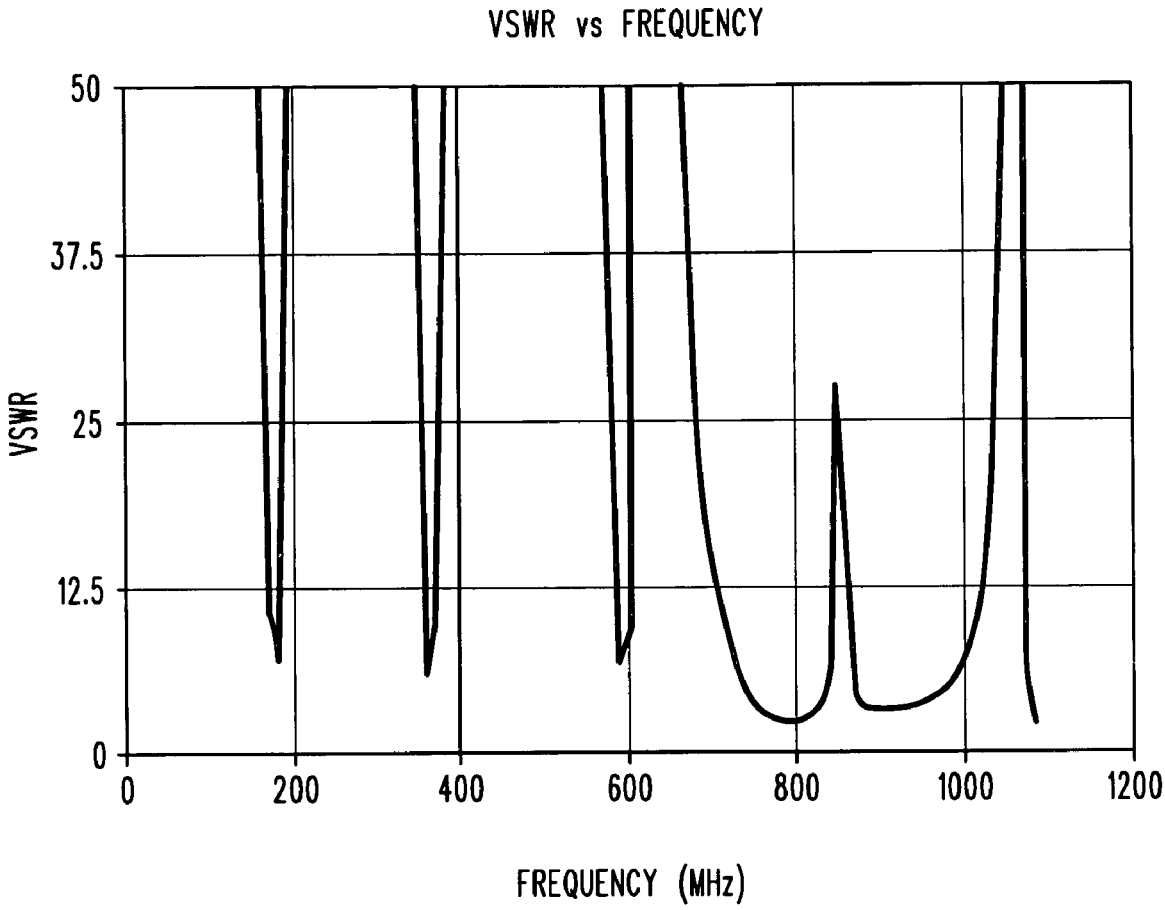
FIG. 11 is a graph representing a simulation of voltage standing wave ratio (VSWR) versus frequency of an antenna wire formed in accordance with an exemplary embodiment of the invention.
Figure 12:
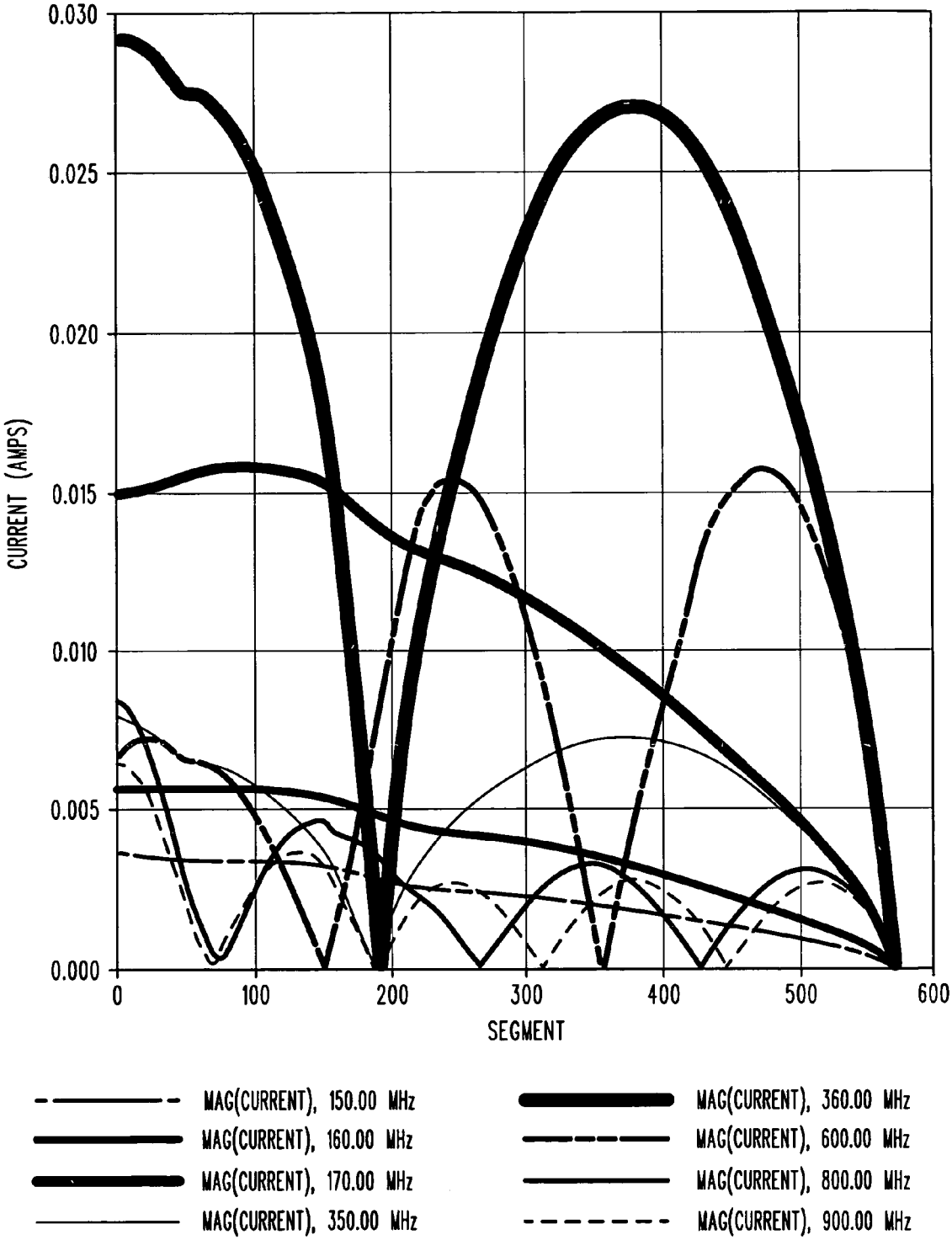
FIG. 12 is a graph representing a simulation of current distribution over segment portions for each band of operation for the antenna of FIG. 11.

FIG. 11 is a graph representing a simulation of voltage standing wave ratio (VSWR) versus frequency of an antenna wire formed in accordance with an exemplary embodiment of the invention This simulation shows the multi band antenna operating in the following band: 150 MHz, 350 MHz, 600 MHz, 750–830 MHz band, 870–950 MHz. FIG. 12 is a graph representing a simulation of the current distribution over segment portions for each band of operation for the antenna of FIG. 11. The antenna operates in the following electrical lengths:

150 MHz 0.25λ;
160 MHz 0.25λ;
170 MHz 0.25λ, maximum current.
350 MHz ¾λ;.
360 MHz ¾λ, maximum current;
600 MHz, 1.25λ;
800 MHz, 1.75λ; and
900 MHz, 1.25λ.

By setting dimensions to variables, defining relationships per product requirements and targets and then optimizing the number of turns and pitch of each segment target, predetermined bandwidths can be achieved. Manipulating the pitch and number of turn combinations of a helical element provides an antenna with significant advantages. Electronic devices requiring multi band capability, particularly portable electronic devices, can benefit from the size, flexibility, adaptability, performance, ease of manufacturability and cost of the antenna formed in accordance with the present invention. The antenna can be mounted to a chassis with industrial RF connectors, detachable antenna connectors or directly to the transceiver. No coaxial connector is required but can be used if desired.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

The invention claimed is:

1. A method for forming an antenna for dual band operation, comprising the steps of:

providing a helical radiating element having a single feed;

configuring a first section of the element to be a quarter wavelength at a GPS frequency band of the dual band of operation; assigning a number of turns with abrupt difference in pitch for a second section of the element for charge accumulation and discontinuity in physical dimension;

selecting a number of turns and pitch combination for a third section to produce a total electrical length for the entire helix to be 1 .25λ; and re-iterating the choice of pitch for the first section to optimize an impedance match for both UHF and GPS bands.

2. The method of claim 1, wherein the step of selecting the number of turns further includes the step of determining the wavelength per turn and calculating a resultant electrical length for the pitch.

* * * * *